US007464653B2

(12) United States Patent
Dodge

(10) Patent No.: US 7,464,653 B2
(45) Date of Patent: Dec. 16, 2008

(54) EXPANSIBLE TABLE

(75) Inventor: Martin J. Dodge, Somerset (GB)

(73) Assignee: Statecraft International Inc., Port Vila (VU)

( * ) Notice: Subject to any disclaimer, the term of this patent is extended or adjusted under 35 U.S.C. 154(b) by 315 days.

(21) Appl. No.: 11/131,439

(22) Filed: May 17, 2005

(65) Prior Publication Data

US 2006/0075940 A1 Apr. 13, 2006

Related U.S. Application Data

(60) Provisional application No. 60/618,314, filed on Oct. 13, 2004.

(51) Int. Cl.
*A47B 1/02* (2006.01)

(52) U.S. Cl. ..... 108/86; 108/67

(58) Field of Classification Search ..... 108/63, 108/66, 72, 76, 83, 84, 85, 86, 67, 68
See application file for complete search history.

(56) References Cited

U.S. PATENT DOCUMENTS

| | | | | |
|---|---|---|---|---|
| 838,671 | A * | 12/1906 | Turner | 108/66 |
| 1,547,685 | A * | 7/1925 | Rhodes | 108/66 |
| 1,853,527 | A * | 4/1932 | Wurm | 108/67 |
| 5,156,095 | A * | 10/1992 | Hansbaek et al. | 108/66 |
| 5,237,937 | A * | 8/1993 | Peltier et al. | 108/66 |
| 6,009,814 | A | 1/2000 | Rossi | 108/66 |
| 6,994,032 | B2 * | 2/2006 | Conley et al. | 108/65 |
| 2004/0194672 | A1 * | 10/2004 | Conely et al. | 108/83 |

FOREIGN PATENT DOCUMENTS

| | | | |
|---|---|---|---|
| CH | 514312 | A | 10/1971 |
| GB | 6788 | | 0/1835 |
| GB | 2396552 | A | 6/2004 |
| WO | WO 2004/089158 | A1 | 10/2004 |

OTHER PUBLICATIONS

International Preliminary Report on Patentability, Apr. 17, 2007, PCT/IB2005/004066, The International Bureau of WIPO, Switzerland.
601-306 Radial Expansion Table, The Oscar de la Renta Home Collection, Century Furniture Industries, website printout, 2004.
Ilona Radially Expanding Table, David Fletcher, website printout, 2004.
Schwartz, Radially Expanding Table, David Fletcher, website printout, 2004.
Patent Cooperation Treaty, Written Opinion of the International Searching Authority, Oct. 19, 2006, pp. 1-13, European Patent Office.
Translation of CH514312A, Patent, Dietiker & Co., Oct. 31, 1971, obtained by Applicant.

* cited by examiner

*Primary Examiner*—José V Chen
(74) *Attorney, Agent, or Firm*—Jack B. Hicks, Esq.; Womble, Carlyle Sandridge & Rice, PLLC

(57) ABSTRACT

A table comprises a table base having a table top, horizontally-fixed sections positioned atop the table base, and a plurality of self-storing expansion leaves that have at least a first length and a second length. The expansion leaves have a first length when stored within the table base and a second length when placed between the fixed sections. Double pivoting hinges connect the expansion leaves to the table base.

20 Claims, 15 Drawing Sheets

EXPANSIBLE TABLE

RELATED APPLICATIONS

This application claims the benefit of U.S. Provisional Application Ser. No. 60/618,314, filed on Oct. 13, 2004.

FIELD OF THE INVENTION

This invention relates to tables and more specifically to a 2-position, expansible table with self-storing leaves.

BACKGROUND

Radial or round tables have been used for centuries for dining and other purposes. A historical limitation of such tables concerns the inability of such tables to easily expand when needed for larger dinner parties or functions that require more table space. Rectangular tables, on the other hand, have long offered leaf sections that allow the length of the table to increase to accommodate greater surface area provided by the inserted leafs.

Several designers have attempted approaches to allow a user to increase the surface area of radial tables, in particular. In one solution, circumferential outer sections or partial rings are designed to fit on the outer edges of a round table, thereby allowing the diameter of the table to increase. In another and quite famous solution, Robert Jupe developed around 1835 a radial table containing sections that diverge from a common center to allow for insertion of expansion leaves. In one embodiment, the Jupe table would increase in diameter by rotating its perimeter in the manner of a ship's capstan. After rotation, the pie sections of the table would spread and move radially outwards. Expansion leaves or "fence posts," stored separately from the table, would then fill the voids created from the expanding pie sections, thereby creating a larger radial table. Robert Jupe and his associates produced many such "Jupe" or "Capstan" tables throughout the Nineteenth century.

One of the principle drawbacks of the solutions of others is the requirement that the expansion wedges or rings must also be stored remote from the table. This makes the expansion process cumbersome and slow. Further, the rotating features of the Capstan contributed to the cost and size of the tables.

Hence there remains a need for a method and mechanism to expand a table of various shapes, including radial tables, without the requirement of remote storage of expansion sections and without complicated and cumbersome mechanisms.

SUMMARY OF THE INVENTION

In accordance with an embodiment of this invention, a table comprises a table base having a table top with an outer edge. A plurality of sections is positioned on the table top. A plurality of self-storing expansion leaves are included, each having a stored length when the leaves are stored under the table top, and an installed length when the leaves are positioned adjacent to the sections on the table top. In an embodiment, the stored length is different than the installed length. The leaves when installed have a first end and a second end, and only one end partially forms the table top outer edge.

In another embodiment, a table comprises a table top having a first surface area, a table base (the base having legs or other type of stand to rest upon a floor or support), a means for expanding the table top to expose expansion leaves stored under the table top and in or under the table base, the means for expanding not including the rotation of the table base or table top, and a means for positioning the expansion leaves on the table top to form a second surface area. A method for expanding a table is also described herein. The table, having a table base and a plurality of table top sections defining a first surface area, is expanded by withdrawing outwardly the sections to expose a plurality of expansion leaves stored within the table base, the withdrawing of the sections occurring with no rotational movement of the table base. The expansion leaves are positioned adjacent to the sections and the sections are converged such that the sections become adjacent to the expansion leaves to substantially define a second surface area.

These and other aspects of the present invention will become apparent to those skilled in the art after a reading of the following description of the preferred embodiments, when considered in conjunction with the drawings. It should be understood that both the foregoing general description and the following detailed description are exemplary and explanatory only and are not restrictive of the invention as claimed.

DETAILED DESCRIPTION

The expansible table of this invention is shown and described in preferred embodiments in the description below.

Figure 1:
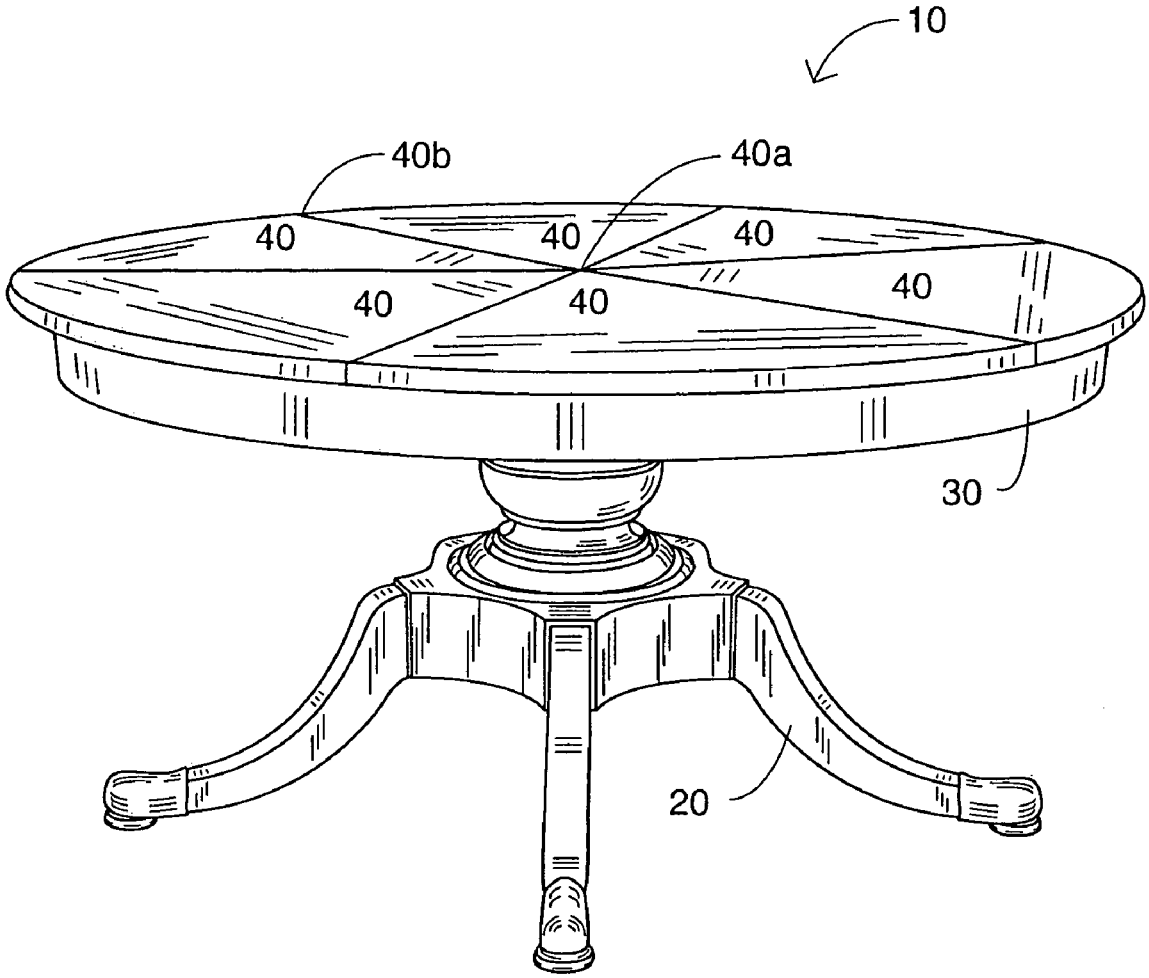
FIG. 1 shows a radial table of the present invention, shown in its first position.

FIG. 1 shows a radial table 10, comprising a pedestal 20, table base 30 having a closed bottom (shown as 32 in FIG. 2) and a top section comprised in an embodiment of six (6) similarly-dimensioned wedges 40. The table 10 is shown in its first position, which coincides with the smallest table top surface area. In the exemplary table, the table has a diameter of about 60 inches, with each wedge 40 having a length of about 30 inches between the tip 40*a* of the wedge and the outer edge 40*b* of the wedge.

Figure 4:
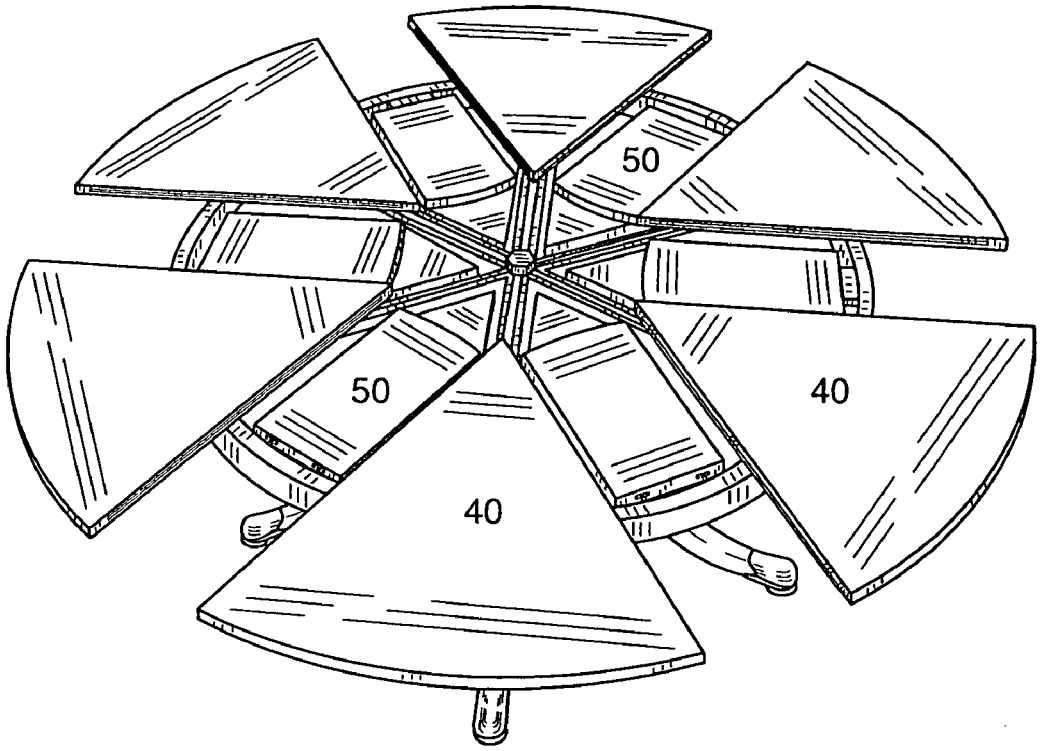
FIG. 4 is an expanded view of the table with all of the wedges outwardly withdrawn.
Figure 5:
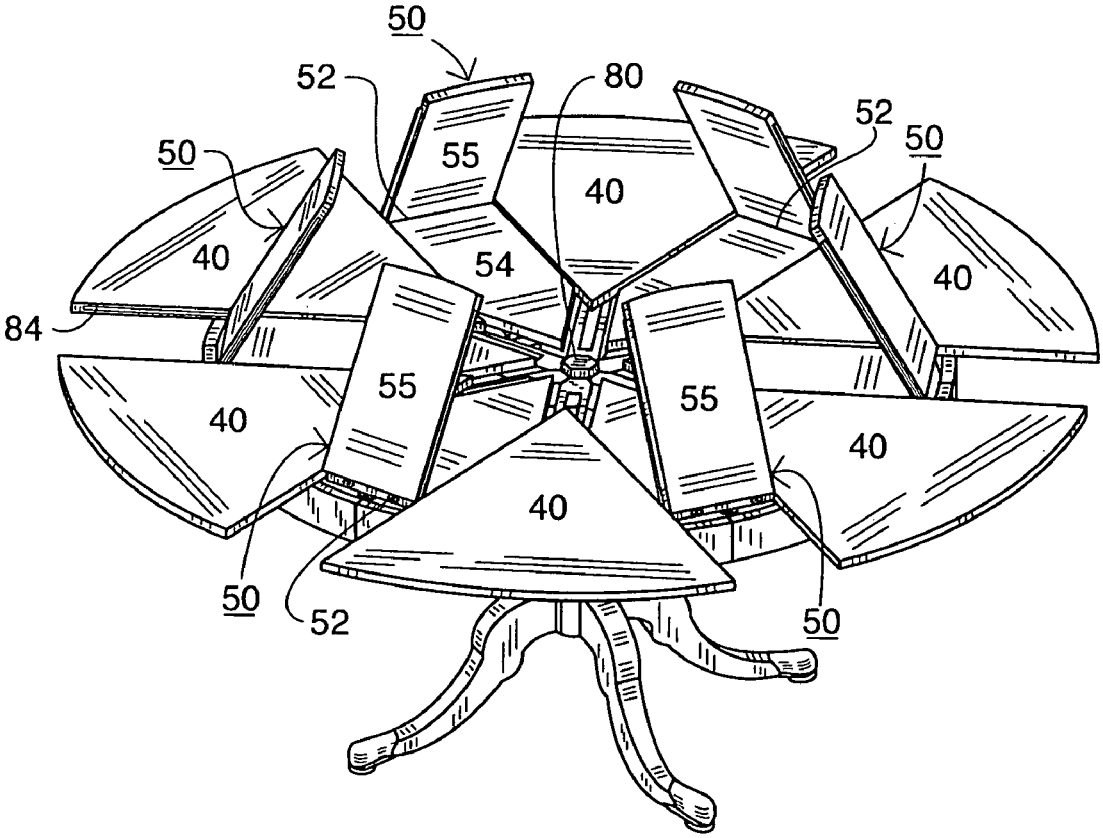
FIG. 5 shows a radial table with expansion leaves unfolding.

As shown principally in FIGS. 2 through 5, to enlarge the radial table, the wedges 40 are pulled radially outward from the center. A stop (not shown) beneath each wedge 40 limits the outward travel of the wedge. The wedges move or glide on rails 42 that are mounted on the floor of the closed bottom 32, and can have a mating protrusion (not shown) on the underside of the wedges 40 to engage the rails 42. When the wedges 40 are moved radially outwards, there are revealed (between the wedges 40) the expansion leaves 50. In an embodiment, each leaf 50 comprises an inner panel 54 and an outer panel 55 as shown in FIG. 5. In the embodiment shown, six (6) expansion leaves 50 are used. FIG. 4 is illustrative of the entire table 10 when all of the wedges 40 are withdrawn to expose all of the leaves 50, prior to their unfolding.

Figure 2:
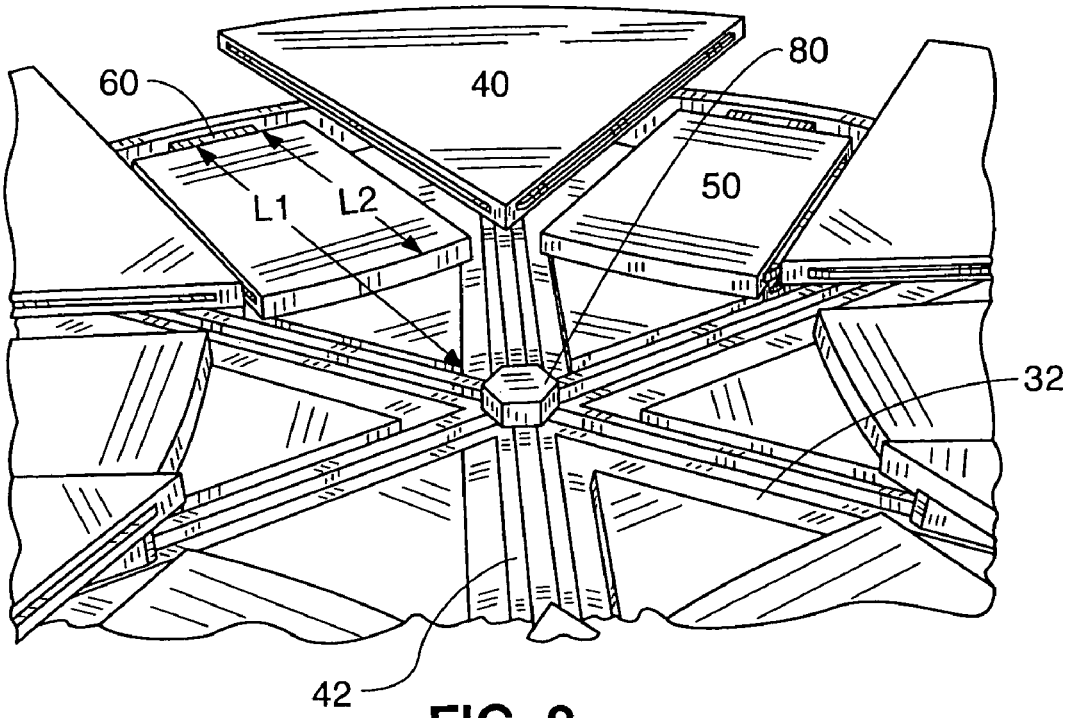
FIG. 2 shows the radial table during a stage in the expansion.
Figure 3:
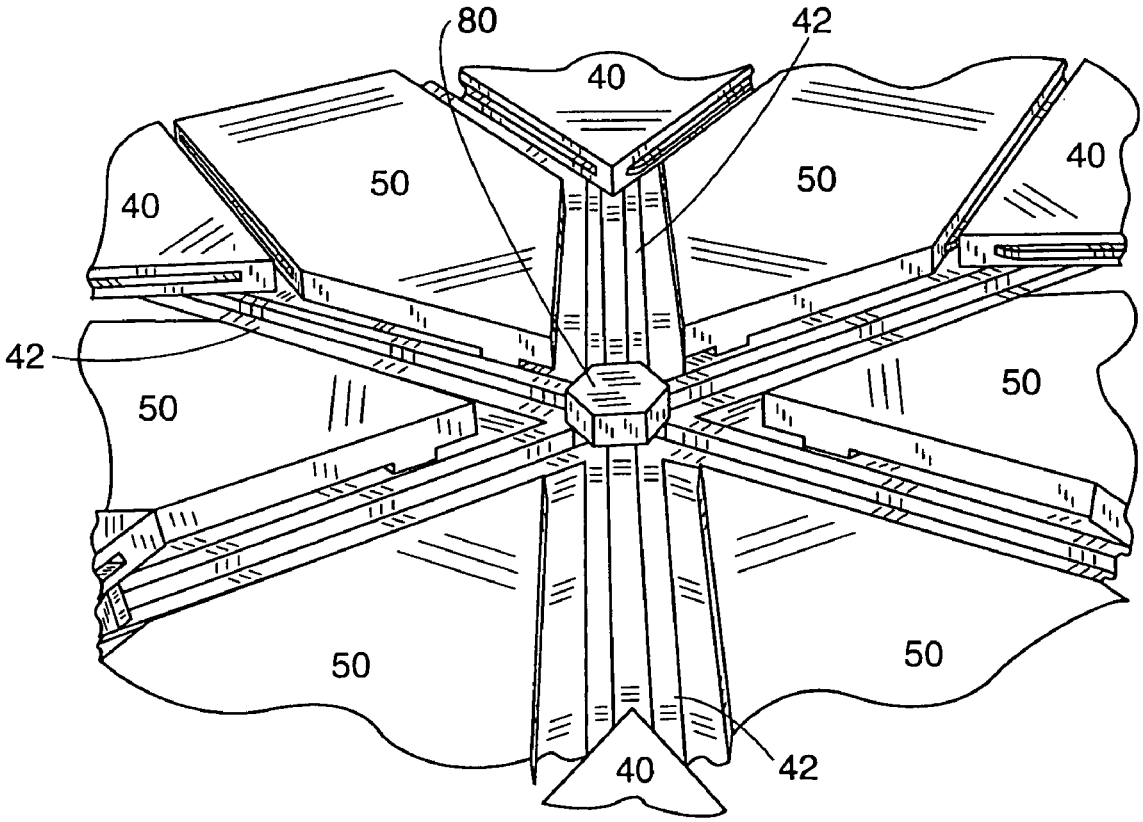
FIG. 3 is an enlarged view of the center section of the radial table during a stage in the expansion.
Figure 6A:
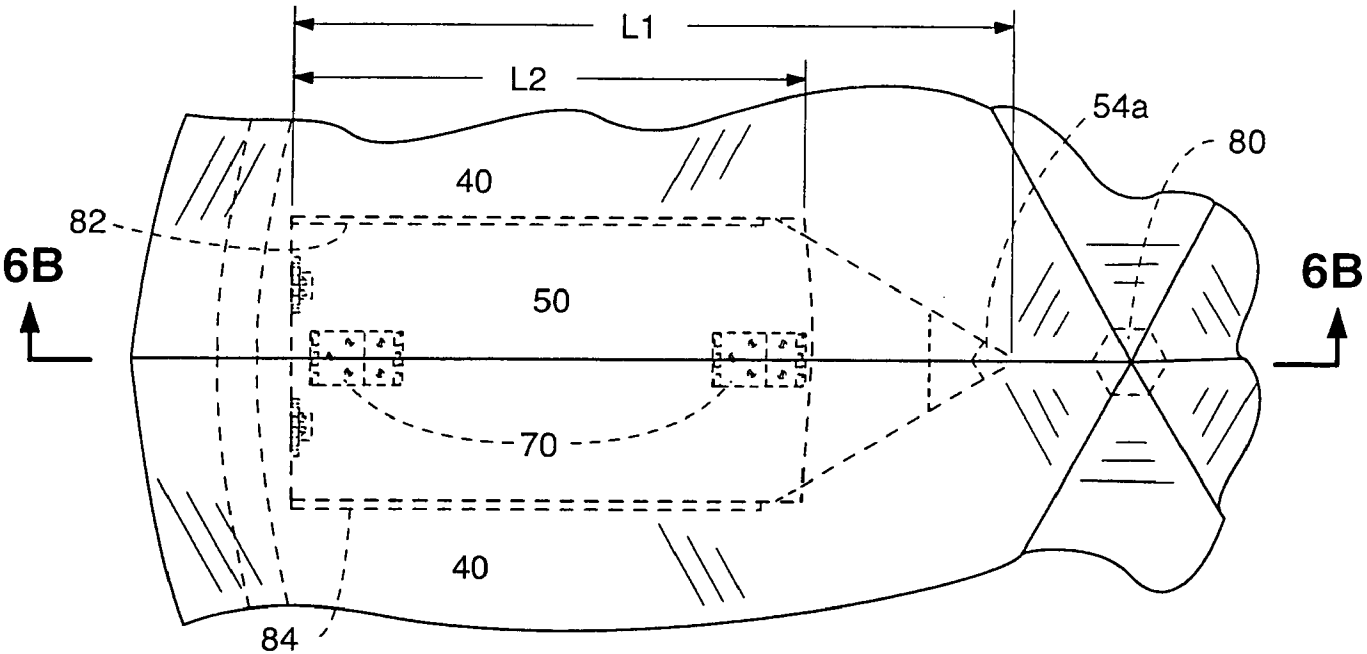
FIGS. 6A and 6B show top and cross-section views of the expansion leaves and hinges.

As shown also in FIGS. 6A and 6B, the leaves 50 are stored within the table base 30 and fit below the planar surface of the table when the table is in its first position. To accommodate a longer expansion sleeve and hence a larger expanded table, the leaves 50 can be folded when the leaves 50 are stored within the table base 30 when the table is in its first position. When stored, the leaves can be said to have a shorter length L1 or L2. The leaves pivotally unfold to extend to a second maximum length L3 (shown in FIG. 10). In one embodiment, the leaf is made up of panels, which fold about pivot 52. When folded, the panels can have one or more shorter lengths, such as L1 or L2 as shown in FIG. 2. The pivot 52 does not have to be at the midpoint. As shown, neither L1 or L2 is one-half of L3. Other variations are within the scope of this invention, including an embodiment where the leaves have a plurality of folds, and plurality of lengths, each of which has at least one dimension that is less than the final, in position, length L3. The maximum length L3 is sufficient to substantially define or contribute substantially towards the radius when a radial table is in its fully expanded position with its maximum surface area.

FIGS. 5 through 7 further illustrate the continuation of the expansion process in an embodiment. The leaves 50 are unfolded outwardly around pivot 52. In the embodiment illustrated in the figures, two Soss-type pivots 52 adjoins the two pieces of each leaf 50. This hinge is available from Hafele America Company. As shown in FIG. 5, a user may grasp the folding outer panel 55, and rotate the panel 55 radially outward about pivots 52. As a leaf 50 is unfolded, the inner panel 54 of the leaf raises upwardly toward the planar surface of the wedges 40. The folding panel 55 cooperates with a shoulder 60 to cause the inner panel 54 to raise up and move radially inwards as a result of the operation of the double pivoting hinges 70. In an embodiment, the shoulder 60 is about 55 mm in height, 22 mm in depth, and approximately equal to or less than the width of the inner panel 54. The bottom of the outer panel 55 will then rest on the ledge 30*b* of the base 30.

Figure 6B:
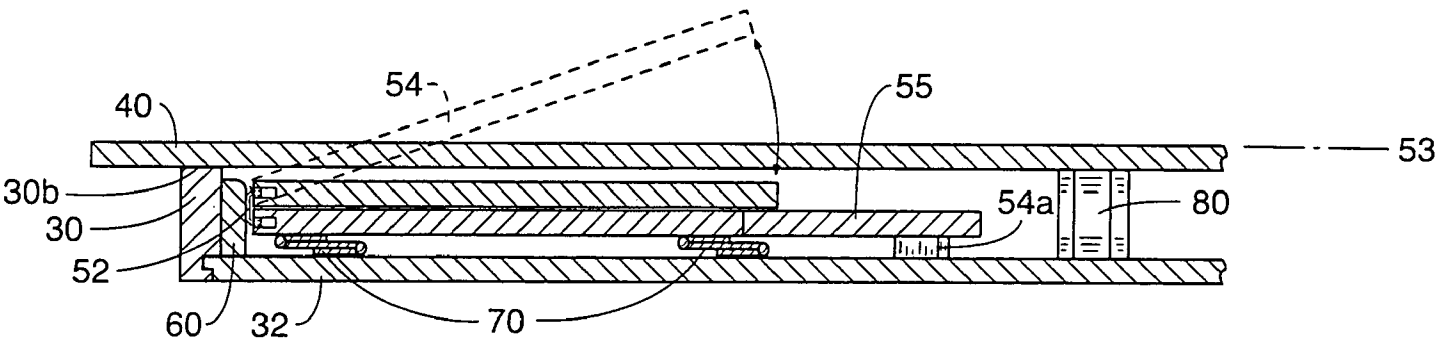
Figure 7A:
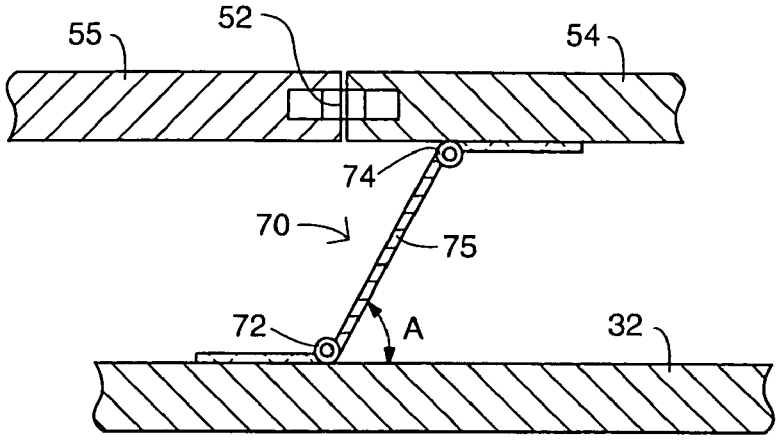
FIG. 7A shows a double pivot hinge.
Figure 7B:
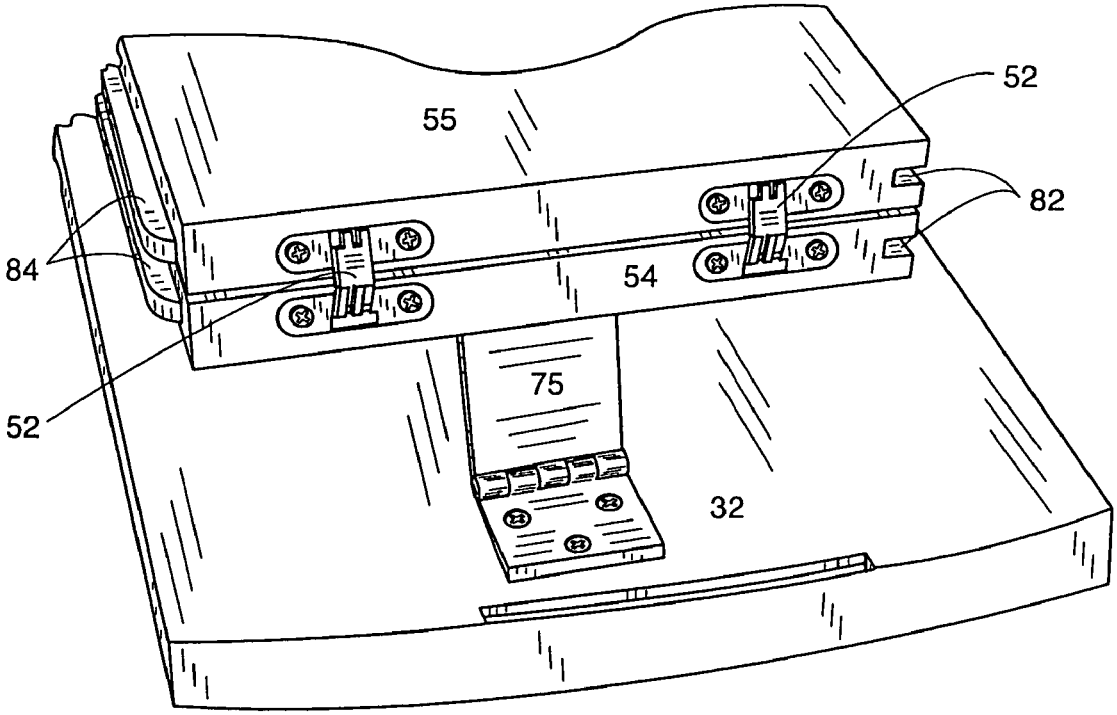
FIG. 7B is a close-up view illustrating the relative placement of the double pivotal hinge of FIG. 7.
Figure 8A:
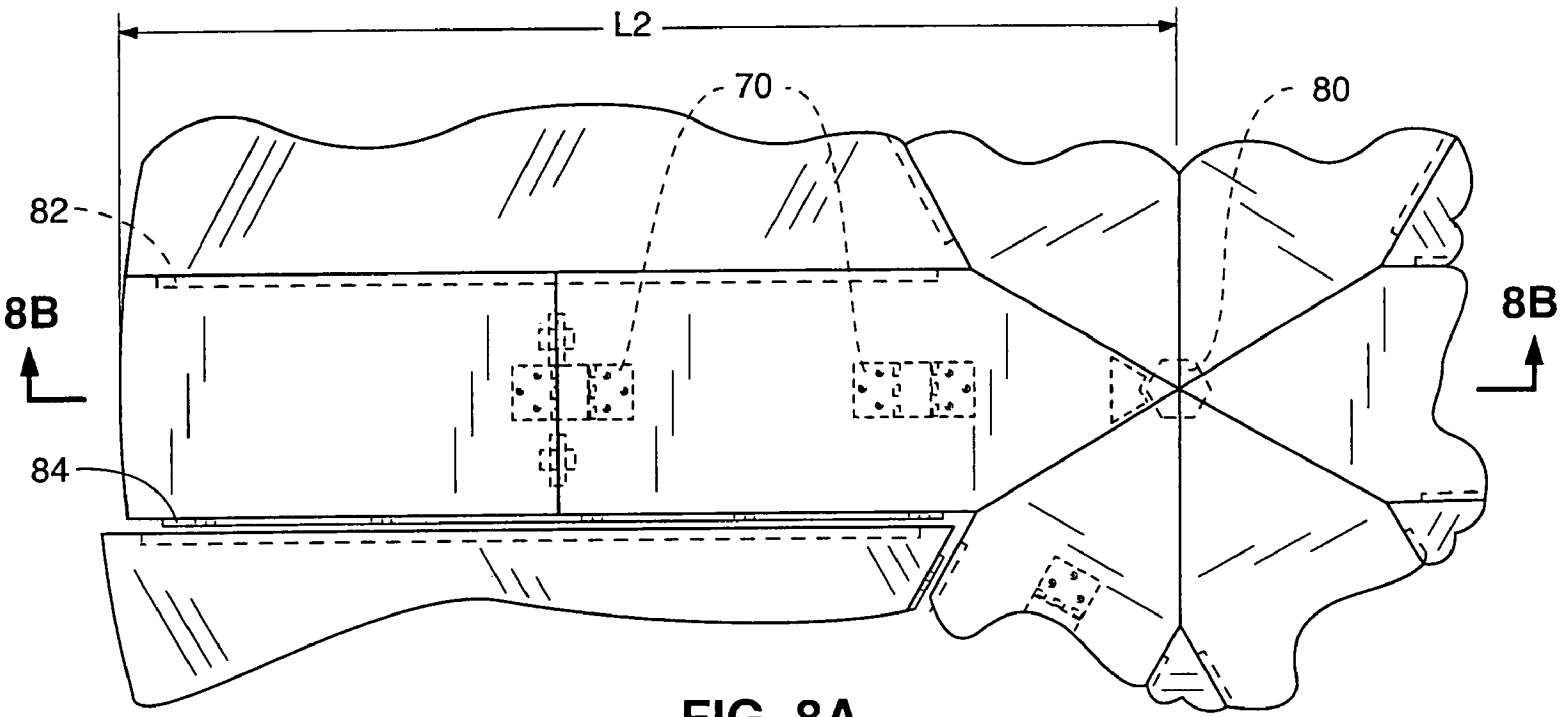
FIGS. 8A and 8B show an additional top and cross-section view of the expansion leaves and hinges.
Figure 8B:
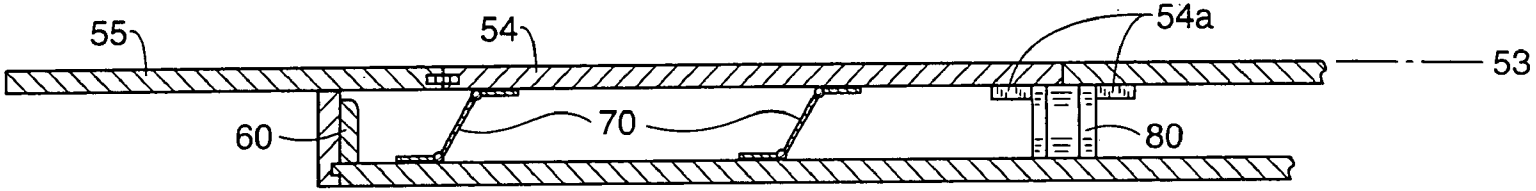

The double pivot hinges 70 permit the inner panel to both rest on the floor of the closed bottom 32 within the base 30, and also raise up to the table planar level 53, as shown in FIGS. 6B and 8B. In an embodiment, each expansion leaf 50 has two hinges 70 attached to the floor of the closed bottom 32 and to the inner panel 54. The hinges 70 have double pivot points as shown in FIG. 7A, which illustrates the leaves 50 in their fully raised and extended positions. In the raised position, an angle A is formed as shown in FIG. 7A. In one embodiment, the angle A preferably is between about 65 and 80 degrees, and most preferably about 72 degrees. The hinge 70 has a rigid portion 75 that must be strong enough to at least partially if not wholly support the inner panel 54 and outer panel 55 when unfolded and raised. In one embodiment, rigid portion 75 is about 65 mm in length. FIG. 7B shows, for illustration purposes, the relative structure and placement of a hinge 70 when the inner panel 54 is partially raised up. Pivot points 72, 74 are positioned at opposing ends of the rigid portion 75. While an embodiment disclosed here incorporates a rigid portion 75 to support the weights and structures described, other weight supporting elements could be employed.

FIGS. 8A and 8B also illustrate the relative position of the double pivot hinges 70 in the extended and raised position.

Figure 9:
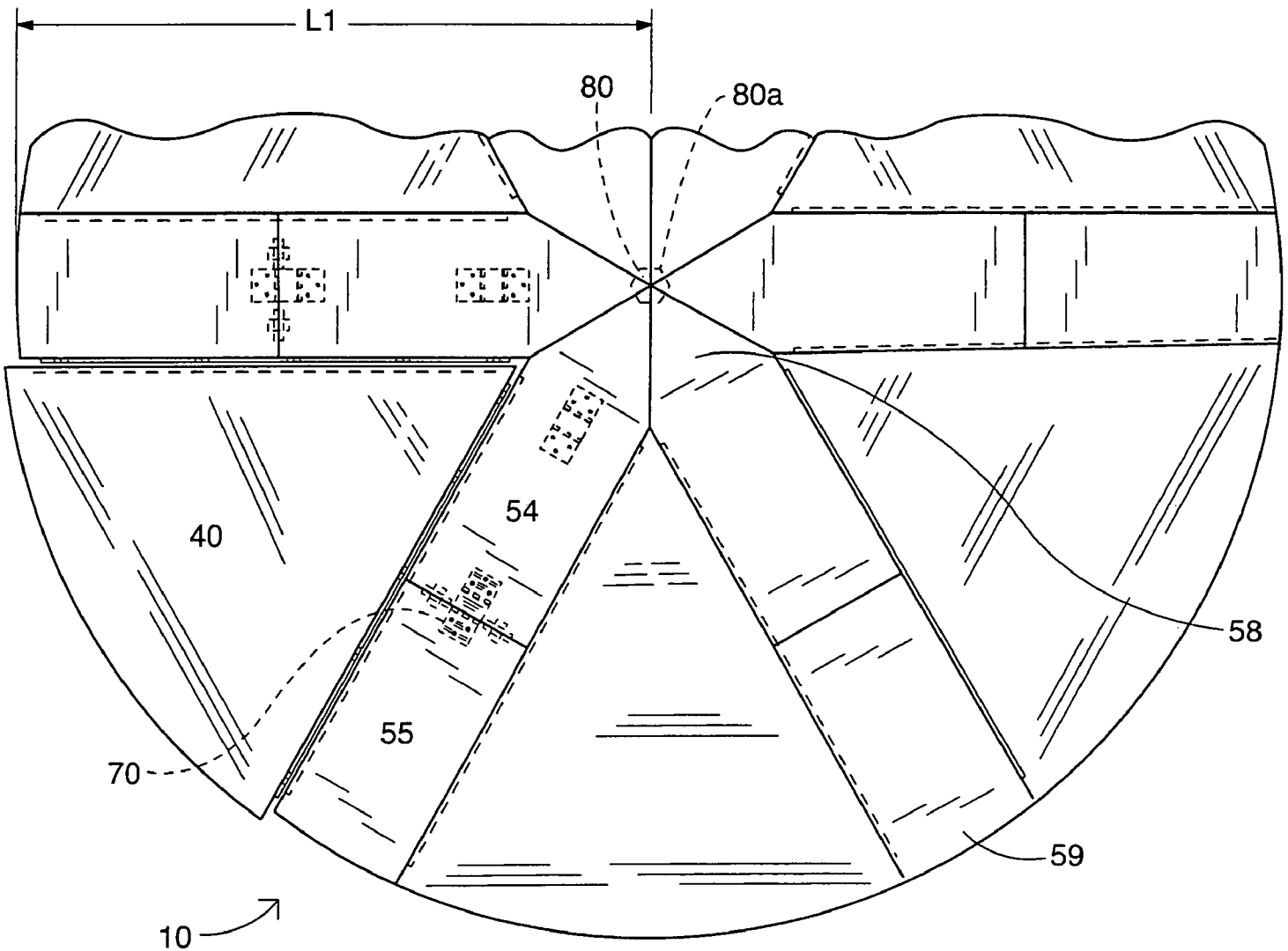
FIG. 9 shows a partial top view of the radial table in an extended position.

FIG. 9 shows a top view of the table 10 once the expansion leaves 50 are unfolded and raised, with at least one of the wedges 40 still in its extended position. A central support, or hub, 80 is also shown, whereupon, in an embodiment, the inwardly most point of the inner panel 54 is supported. The support 80 can be polygonal-shaped, and in the embodiment shown in FIG. 9, comprises six similarly dimensioned sides which intersect at six points 80*a*. As shown in FIGS. 8A and 8B, a stop 54*a*, having a V-shaped notch formed therein, is affixed beneath inner panel 54 to matingly engage point 80*a*. This limits inward travel of the leaf 50 and ensures that the points of the inner panels 54 meet at the center of the support 80.

Once the leaves 50 have been extended and raised, the wedges 40 are slid back towards the center of the table to form a snug fit between the wedges 40 and leaves 50. Optional tongue and groove members, such as the tongue 84 and groove members 82 shown in FIG. 7B, can be added to side edges of the wedges 40 and leaves 50 to facilitate fit.

Figure 10:
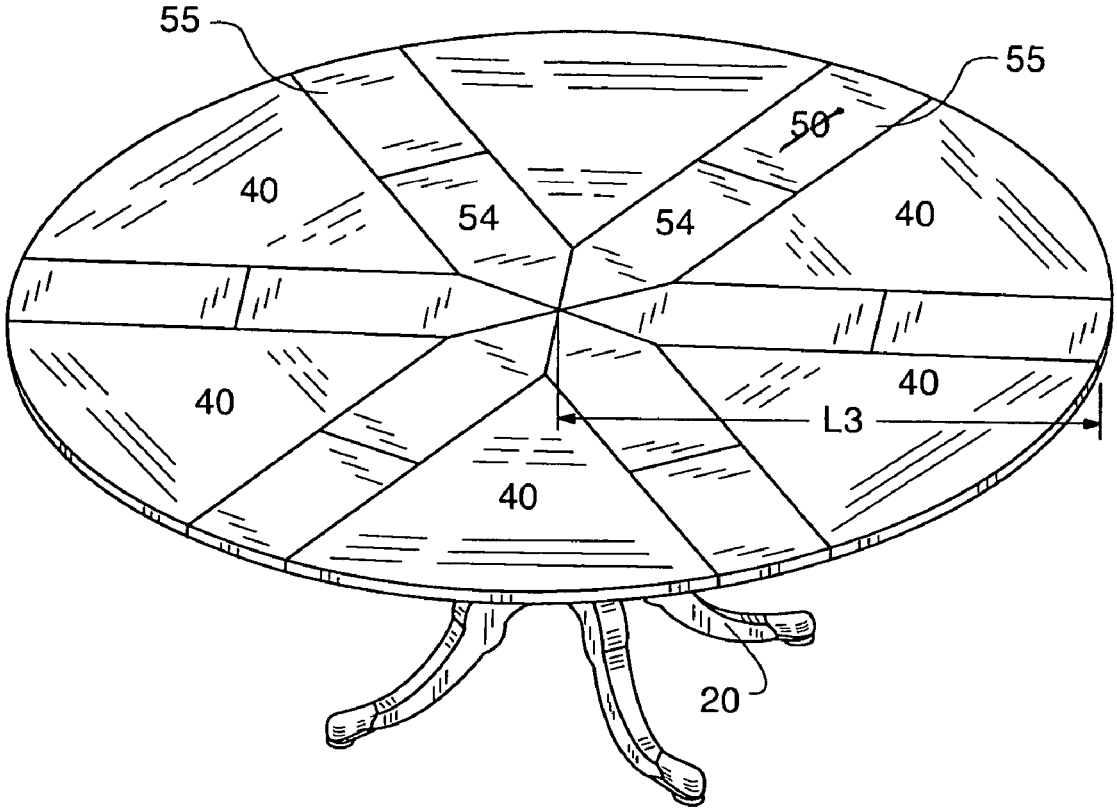
FIG. 10 shows the radial table in a second, enlarged position.

FIG. 10 shows the table in its second position, whereby the maximum surface area is obtained. All leaves 50 are unfolded and raised, and the wedges 40 are placed snugly within the table top. The tips of the leaves combine to form a center section of the second, maximum surface area. In the exemplary table, the table in its second position has a diameter of about 78 inches and a L3 of about 39 inches. As shown, the table is rectilinear, and all leaves are symmetrical about both the major axis and minor axis of the table.

Figure 11A:
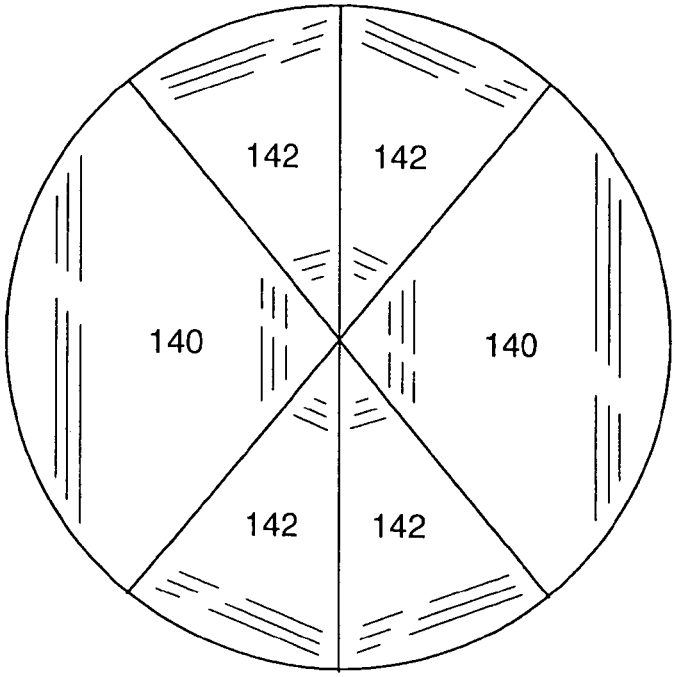
FIGS. 11A and 11B show another embodiment of an expansible table.
Figure 11B:
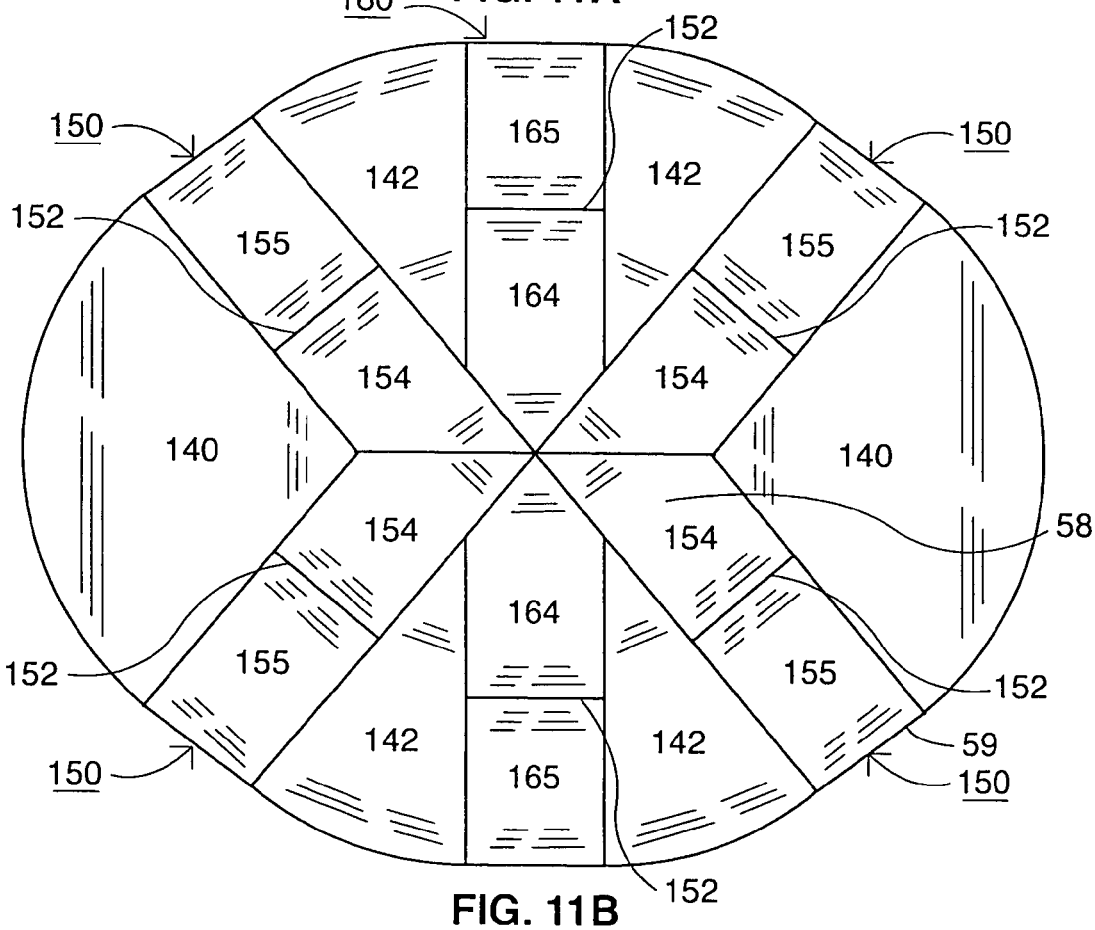

FIGS. 11A and 11B show an embodiment whereby an approximate circular table is converted to approximately an oval table with self-contained leaves. In the first position shown in FIG. 11A, the table surface area is defined by sections 140 and 142. In FIG. 11B, the larger surface area is substantially defined by sections 140 and 142, as well as by self-storing leaves 150 and 154. The leaves 150 (comprising panels 154 and 155) and 160 (comprising panels 164 and 165) fold about line 152, and fit underneath the sections 140 when the table is in its first position. The leaves fold out and are raised in the embodiment shown in FIGS. 11A and 11B in the equivalent manner as described in the previous embodiments herein set forth.

Figure 12A:
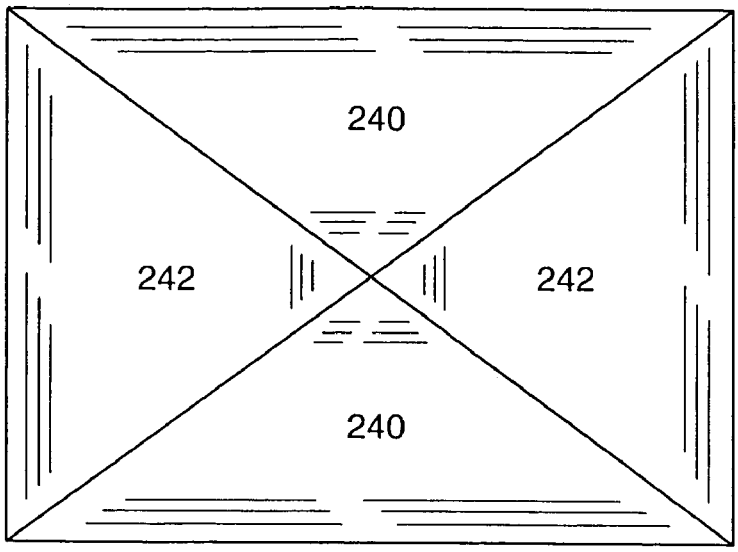
FIGS. 12A and 12B show another embodiment of an expansible table.
Figure 12B:
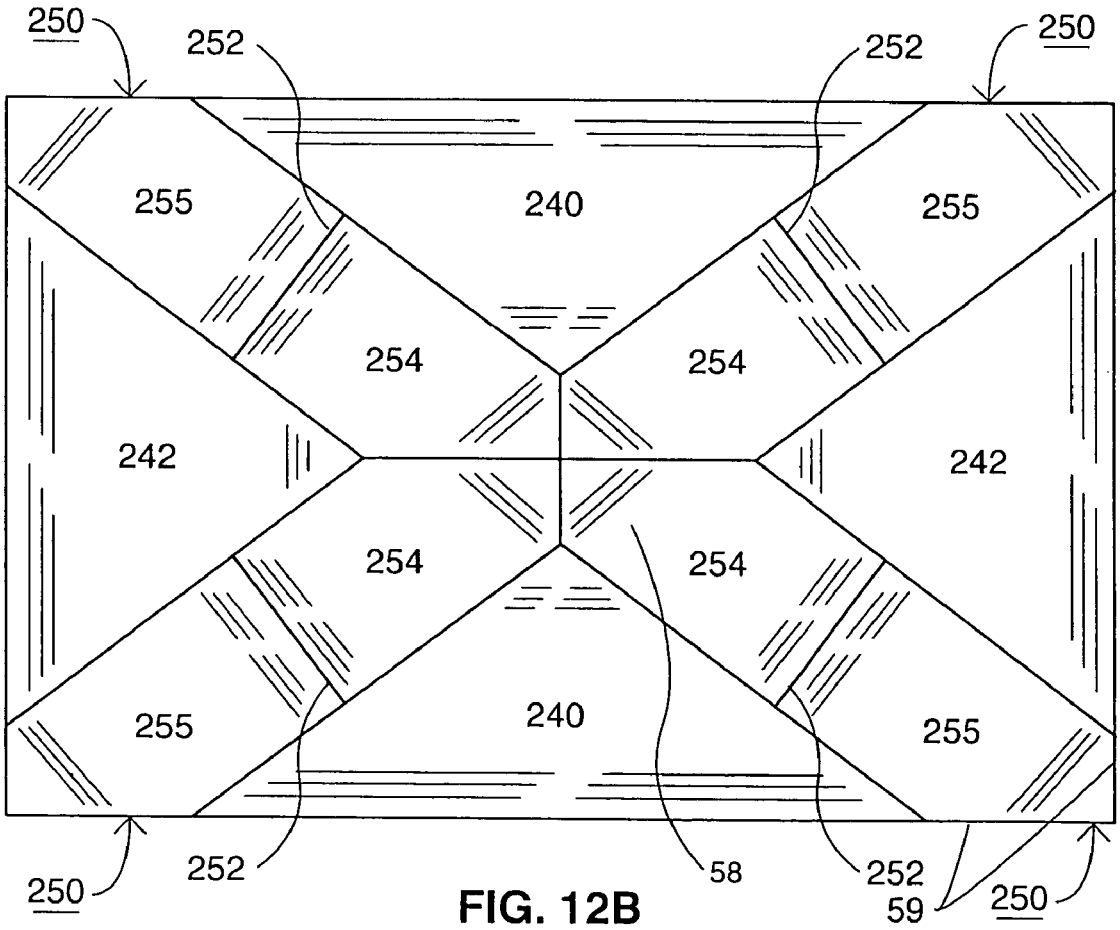

FIGS. 12A and 12B show an embodiment whereby an approximate rectangular table is converted to a larger rectangular table with self-contained leaves. In the first position shown in FIG. 12A, the table surface area is defined by sections 240 and 242. In FIGS. 12B, the larger surface area is substantially defined by sections 240 and 242, as well as by self-storing leaves 250. The leaves 250 (comprising panels 254 and 255) fold about line 252, and fit underneath the sections 240 and 242 when the table is in its first position. The leaves fold out and are raised in the embodiment shown in FIGS. 12A and 12B in the equivalent manner as described in the previous embodiments herein set forth.

Figure 13A:
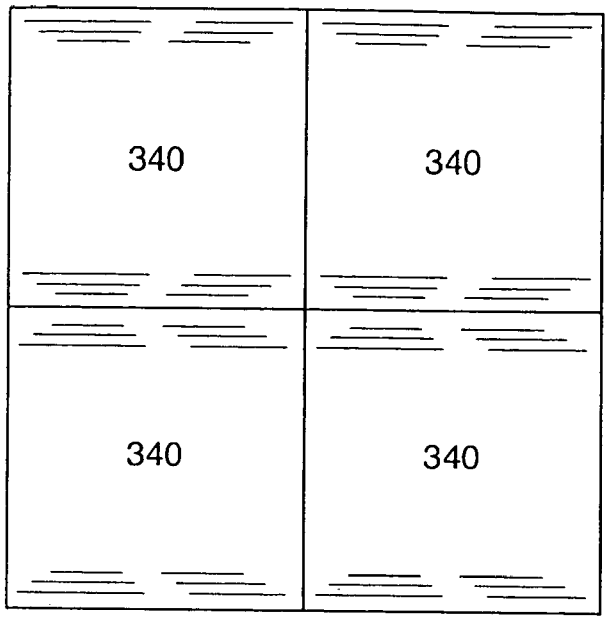
FIGS. 13A through 13C show another embodiment of an expansible table.
Figure 13B:
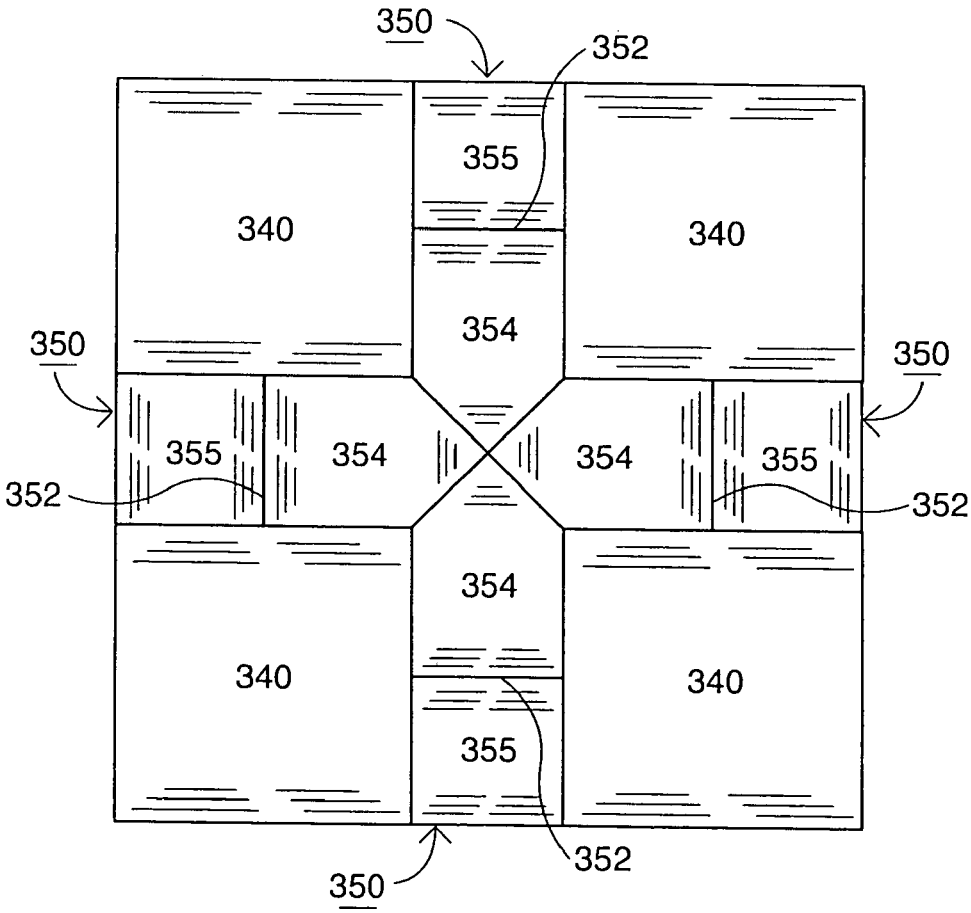

FIGS. 13A and 13B show an embodiment whereby a square table is converted to a larger square table with self-contained leaves. In the first position shown in FIG. 13A, the table surface area is defined by similarly shaped sections 340. In FIG. 13B, the larger surface area is substantially defined by sections 340, which slide outwardly on rails 342, and by the self storing leaves 350. The leaves 350 (comprising panels 354 and 355) fold about line 352, and fit underneath the sections 340 when the table is in its first position shown in FIG. 13A. The leaves fold out and are raised to go from the embodiment shown in FIG. 13A to that shown in FIG. 13B in the equivalent manner as described in the previous embodiments herein set forth.

Figure 13C:
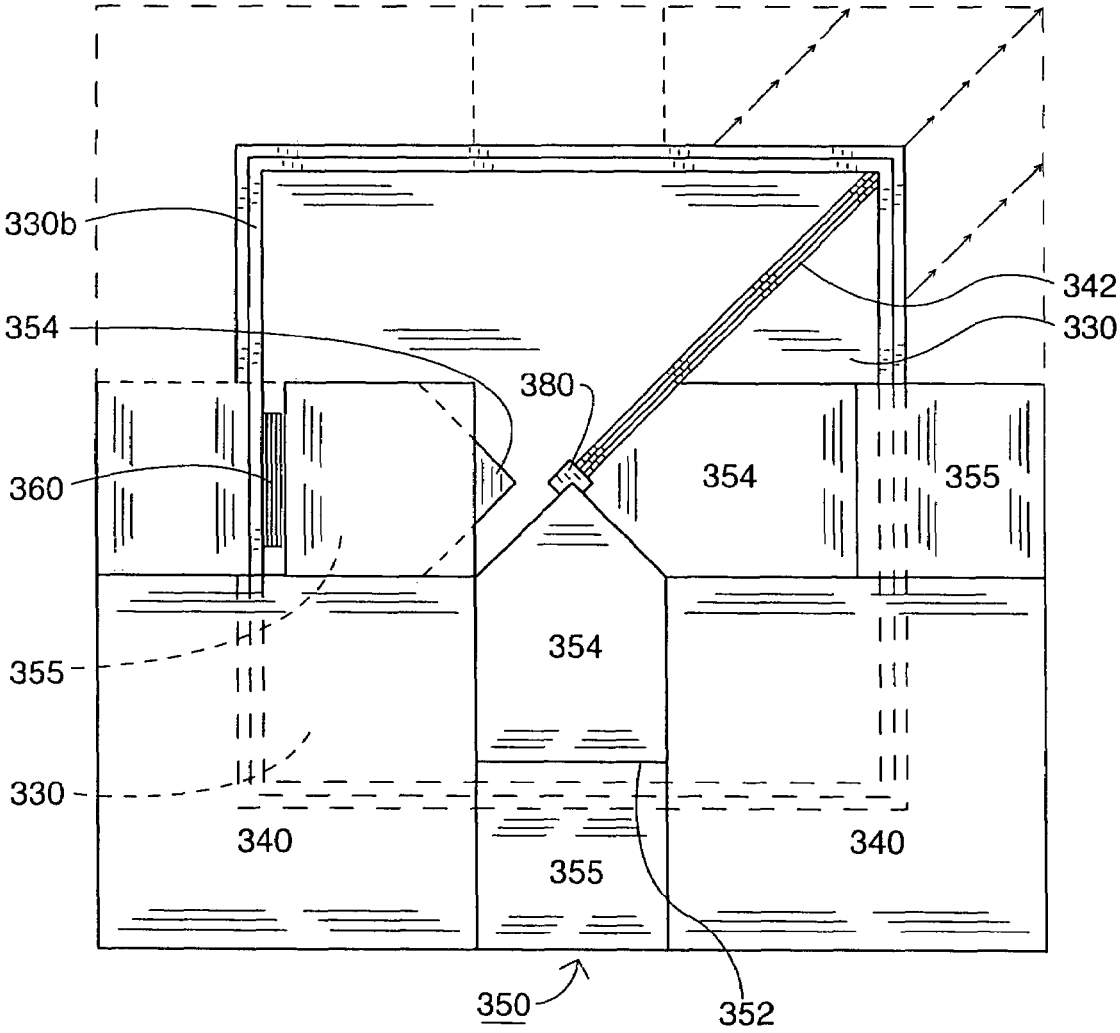

FIG. 13C is illustrative of the expansibility of this design, showing the smaller dimensions of this square table defined by shaped sections 340 and the larger surface area when self storing sections 350 are adjoined with sections 340. As shown in FIG. 13C, outer section 355 and inner section 354 of self storing sections 350 unfold about pivot 352 in cooperation with shoulder 360 to rest upon ledge 330*b* of base 330, and upon support 380.

Figure 14A:
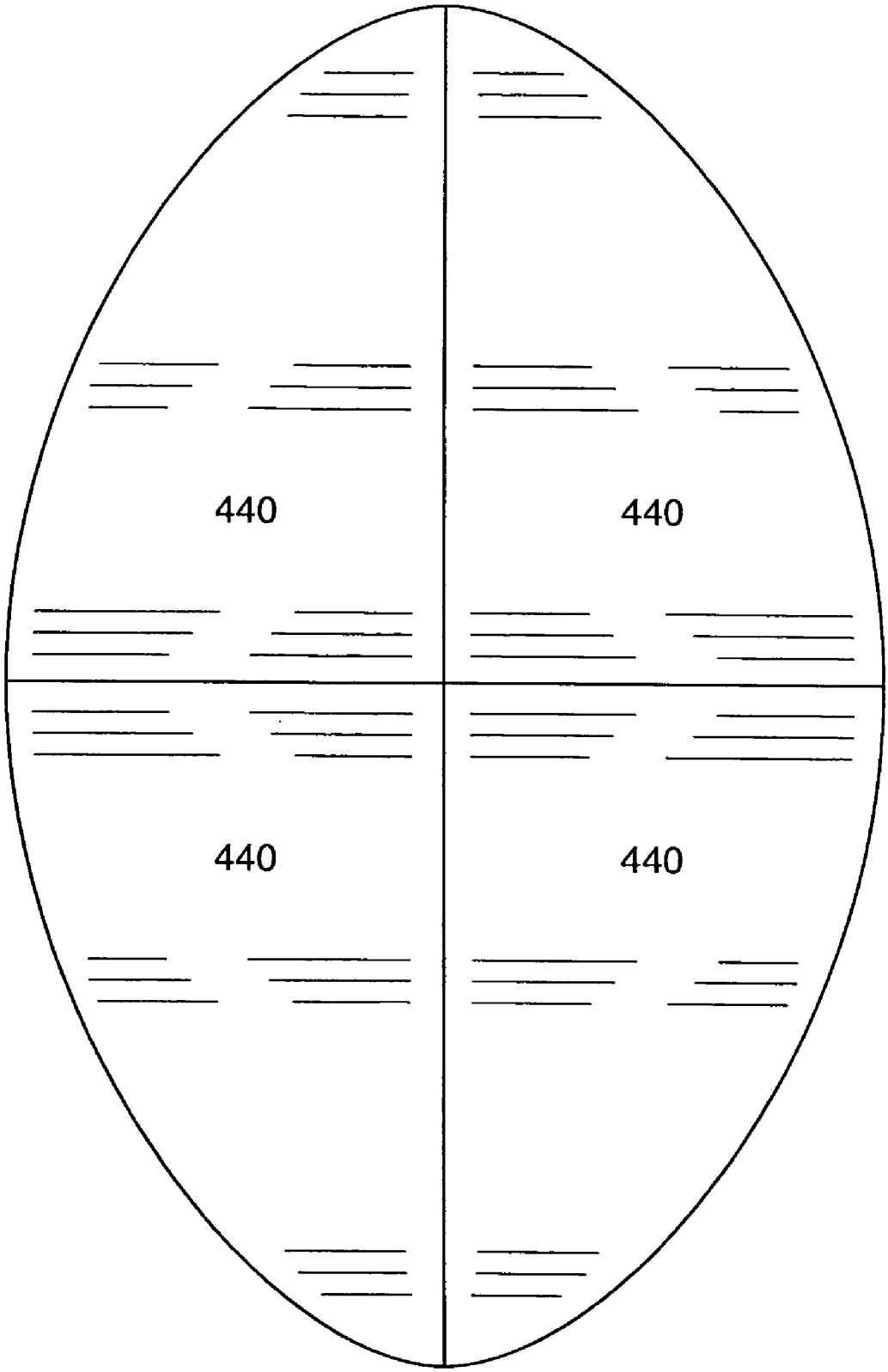
FIGS. 14A through 14C show another embodiment of an expansible table.
Figure 14B:
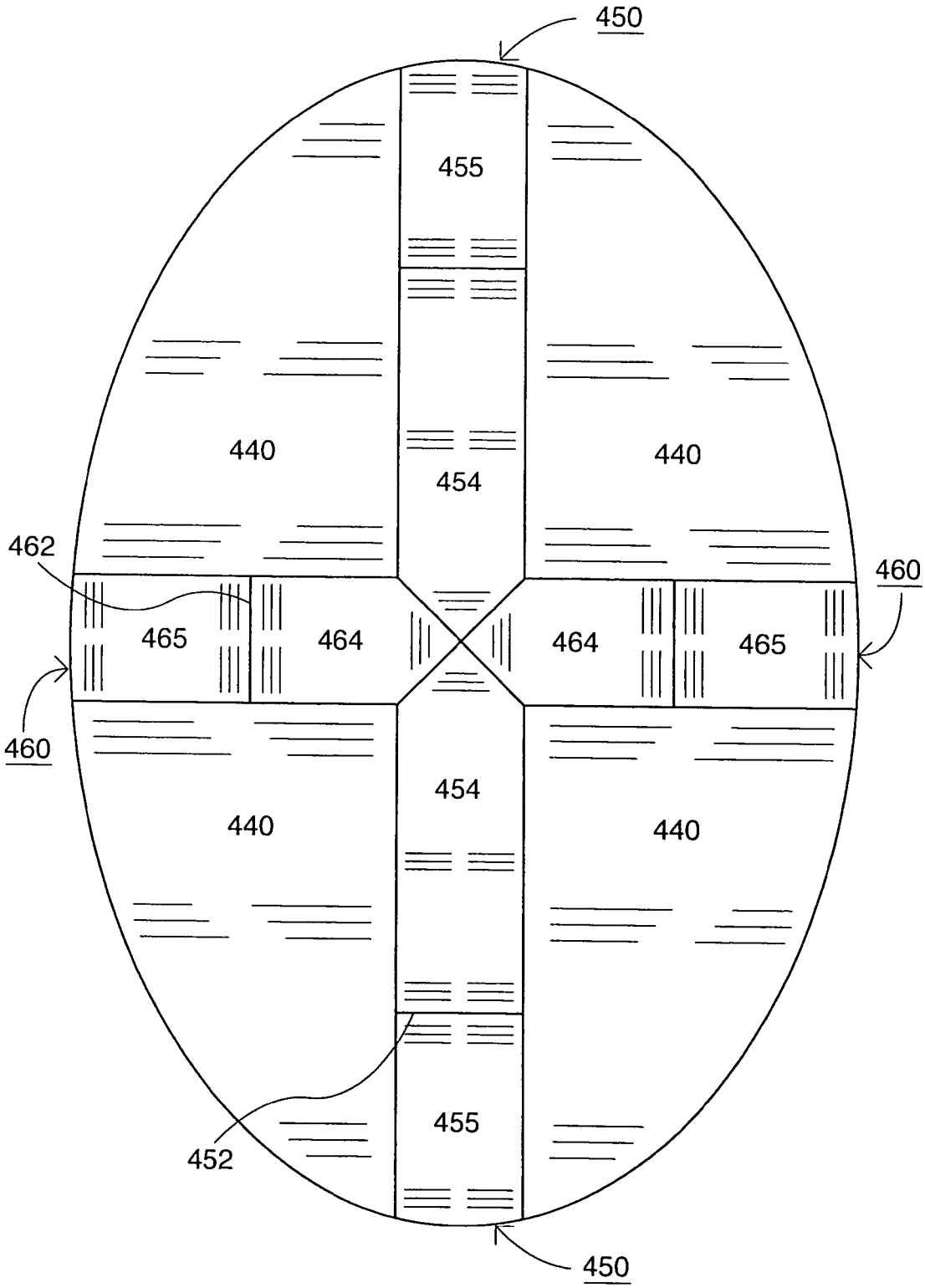
Figure 14C:
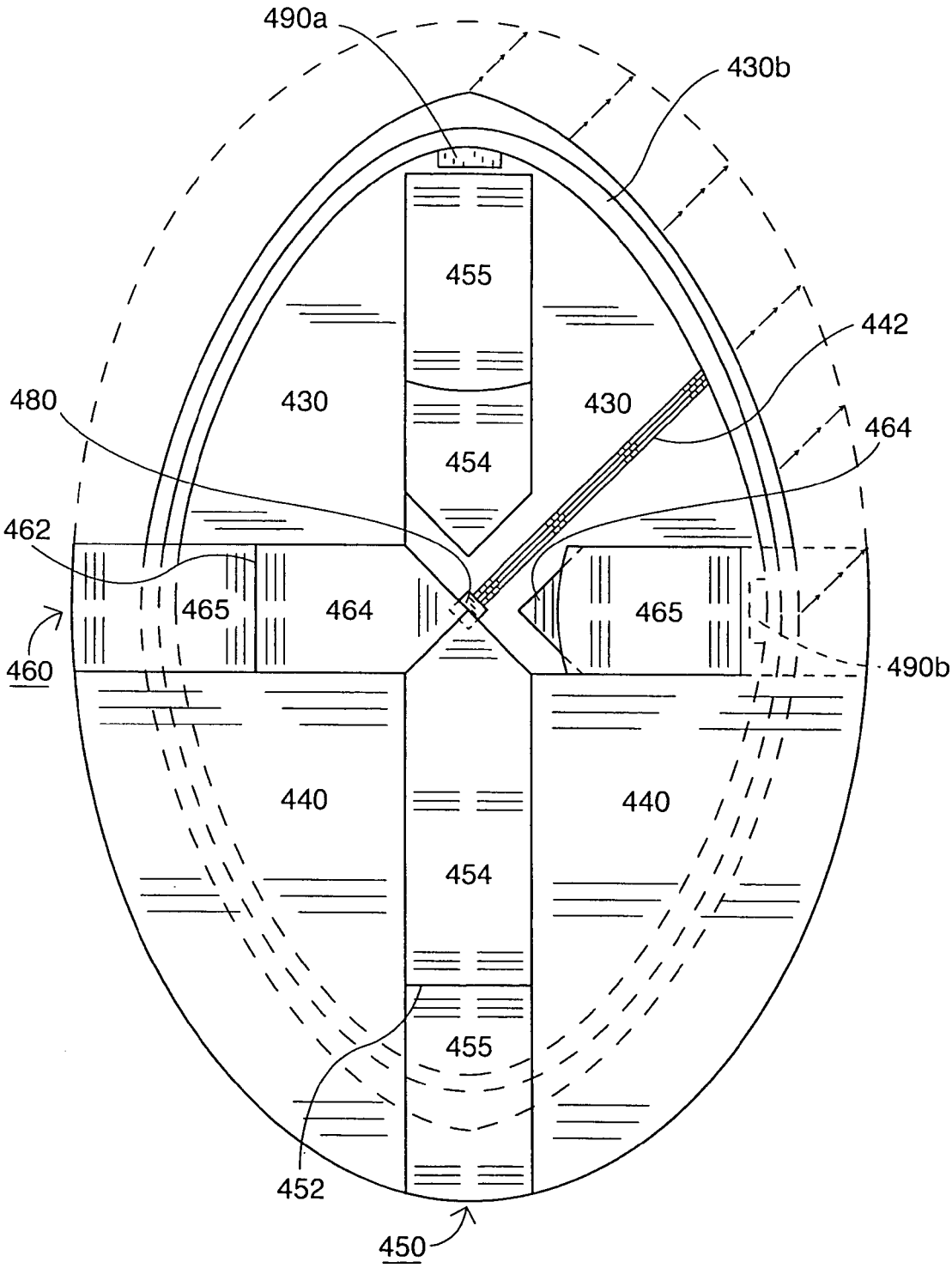

FIGS. 14A and 14B show an embodiment whereby an oval table is converted to a larger oval table with self-contained leaves. In the first position shown in FIG. 14A, the table surface is defined by similarly shaped sections 440. In FIG. 14B, the larger surface area is substantially defined by sections 440 (which slide outwardly on rails 442 as shown in FIG. 14C) and the self storing leaves, 450 and 460. The leaves 450 (comprising panels 454 and 455) and 460 (comprising panels 464 and 465) fold about lines 452 and 462 respectively, and fit underneath the sections 440 when the table is in its first position. The leaves fold out and are raised in the embodiment shown in FIGS. 14A and 14B in the equivalent manner as described in the previous embodiments herein set forth.

FIG. 14C is illustrative of the expansibility of this design, showing the smaller dimensions of this oval table defined by shaped sections 440 and the larger surface area when self storing sections 450 and 460 are adjoined with sections 440. Outer and inner sections 455, 454 of self storing sections 450, and inner and outer sections 465, 464 of self storing sections 460, unfold about pivots 452 and 462 in cooperation with shoulders 490*a* and 490*b* to rest upon ledge 430*b* of base 430, and upon support 480.

In embodiments of this invention, the tables may have a major axis and a minor axis, which are orthogonal to one another. The sections and leaves are symmetrical about both the major axis and the minor axis. The leaves can have two opposite ends, 58 and 59. When the leaves are installed, only one end (59) helps to define the outer edge of the table, the other end being nearer the table center.

While preferred embodiments of the present invention have been described above, it is to be understood that any and all equivalent realizations of the present invention are included within the scope and spirit thereof. Thus, the embodiments depicted are presented by way of example only and are not intended as limitations upon the present invention. While particular embodiments of the invention have been described and shown, it will be understood by those of ordinary skill in this art that the present invention is not limited thereto since many modifications can be made. Therefore, it is contemplated that any and all such embodiments are included in the present invention as may fall within the literal or equivalent scope of the appended claims.

I claim:

1. A table comprising:

(a) a table base having a first table top, the first table top having an outer edge;

(b) a plurality of sections positioned on the first table top;

(c) the table base having a bottom;

(d) a plurality of self-storing expansion leaves, unattached to one another, each having a stored length when the leaves are stored under the table top, and an installed length when the leaves are positioned coplanar to the sections on the table top, the stored length being different than the installed length;

(e) the plurality of sections and the plurality of installed leaves define a second table top;

(f) whereby the leaves when coplanar to the sections on the table top have a first end and a second end, and the first end partially forms an outer edge of the second table top; and (g) whereby the expansion leaves are attached to at least one hinge that is attached to the table base bottom the hinge enabling movement between the stored and coplanar positions.

2. The table of claim 1 wherein each of the sections is movable by divergence from a center of the table and thereby exposing the plurality of stored expansion leaves.

3. The table of claim 1 wherein the table has at least one radius.

4. The table of claim 1 wherein at least one of the expansion leaves comprises:

(a) a plurality of panels; and (b) the plurality of panels being pivotally connected to one another and unfold and raise from a storage position to an installed position.

5. The table of claim 4 further whereby;

(a) each panel proximate to the second end of each leaf comprises an inner section and an outer section, the inner section having an innermost point;

(b) the table base has an outer support and a central hub; and (c) whereby the outer support at least partially supports the panel proximate to the first end of the leaf and the central hub at least partially supports the innermost point of the inner section.

6. The table of claim 5 further comprising a shoulder positioned on the table base, the shoulder assisting in positioning the expansion leaves in their installed length by at least partially assisting in the raising of the panels in their installed position to be coplanar with the sections.

7. The table of claim 1 further comprising at least one double pivot hinge connecting each of the expansion leaves to the bottom of the table base.

8. The table of claim 7 wherein the double pivot hinges partially support the expansion leaves when the expansion leaves are installed between the sections.

9. A non-rectangular table comprising:

(a) a table top having a plurality of sections;

(b) the table top having a convergence point;

(c) a base having a plurality of expansion leaves, the expansion leaves are unattached to one another;

(d) the base having a bottom whereby the expansion leaves are on at least one hinge, the hinge being attached to the bottom and enabling positioning of the expansion leaves to be coplanar to the table top sections;

(e) whereby the table top has a first surface area comprising the plurality of sections, and a second surface area that is at least partially defined both by the plurality of sections and by the plurality of expansion leaves when positioned coplanar to the sections;

(f) the table top having a major axis and a minor axis that are orthogonal to one another, the sections and leaves being symmetrical about both the major axis and the minor axis when the leaves are positioned coplanar to the sections; and (g) the plurality of expansion leaves have a first and second end, and the second end of each of the plurality of expansion leaves has side portions that substantially converge at the convergence point of the table top when the leaves are positioned coplanar to the sections.

10. The table of claim 9, whereby the second surface area is defined solely both by the plurality of sections and by the plurality of expansion leaves positioned coplanar to the sections.

11. The table of claim 9, whereby the expansion leaves have a first length when stored within the table base and a second length when they combine with the sections to define the second surface area.

12. The table of claim 9 whereby the sections and expansion leaves matingly engage one another to assist in ensuring that the sections and leaves are substantially coplanar when combined to form the second surface area.

13. A table comprising:

(a) a table top having a first surface area, the first surface area having a major axis and a minor axis that are orthogonal to one another;

(b) the table top having a convergence point;

(c) a table base;

(d) the table base having a bottom;

(e) means for expanding outwardly along the major axis and the minor axis the table top to expose expansion leaves stored under the table top; and (f) means for positioning the expansion leaves to be coplanar with the table top to form a second surface area the expansion leaves being on a hinge attached to the table base bottom whereby the expansion leaves have a first and second end, and the second end of each of the plurality of leaves has side portions that substantially converge at the convergence point of the table top when the table top forms the second surface area.

14. The table of claim 13 whereby the means for expanding does not include the rotation of the table base or table top.

15. The table of claim 13 whereby the means for positioning the expansion leaves comprises a means for unfolding the expansion leaves, and a means for raising the expansion leaves to be coplanar with the table top.

16. A method for expanding a table having a table base with a bottom and a plurality of table top sections defining a first surface area, the table having a convergence point and having a major and minor axis that are orthogonal to one another, the method comprising:

(a) withdrawing the sections along the major axis and minor axis to expose a plurality of expansion leaves, pivotally attached to the table base bottom and stored with the table base;

(b) positioning the expansion leaves that are on at least one hinge to be coplanar to the sections; and (c) whereby the expansion leaves, when positioned adjacent to the sections, each have side portions that substantially converge at the table convergence point.

17. The method of claim 16 further comprising the step of converging the sections to become adjacent to the expansion leaves to substantially define a second surface area.

18. The method of claim 16 whereby the withdrawing of the sections occurs with no rotational movement of the table base or table top sections.

19. The method of claim 16 wherein the step of positioning the expansion leaves further comprises the steps of unfolding and raising a plurality of panels forming the expansion leaves.

20. The method of claim 19 wherein the step of unfolding and raising the panels is performed using a double pivoting hinge.

* * * * *